United States Patent [19]

Feibelman

[11] 4,281,469

[45] Aug. 4, 1981

[54] REMOVABLE IDENTIFICATION PANEL FOR EARRING CARDS

[75] Inventor: Jeffrey A. Feibelman, Cranston, R.I.

[73] Assignee: A & H Mfg. Co., Johnston, R.I.

[21] Appl. No.: 78,395

[22] Filed: Sep. 24, 1979

[51] Int. Cl.[3] ..... G09F 3/18

[52] U.S. Cl. ..... 40/16.4; 40/5; 40/17; 206/566

[58] Field of Search ..... 40/16, 16.4, 17, 18, 40/19, 20 R, 20 A, 10 D, 5, 1.6, 607, 611, 617; 211/86; 206/566

[56] References Cited

U.S. PATENT DOCUMENTS

| | | | |
|---|---|---|---|
| 558,155 | 4/1896 | Burt | 40/17 |
| 1,479,423 | 11/1924 | Barton | 40/124 X |
| 1,729,249 | 9/1929 | Egan | 40/16.4 |
| 2,119,832 | 6/1938 | Schless | 206/556 X |
| 2,144,968 | 1/1939 | Gerth | 206/566 X |
| 2,634,938 | 4/1953 | Hopp | 40/16.4 |
| 4,043,449 | 8/1977 | Love | 206/556 X |
| 4,044,485 | 8/1977 | Hopp | 40/16.4 |
| 4,099,611 | 7/1978 | Feibelman | 206/566 X |

FOREIGN PATENT DOCUMENTS

| | | | |
|---|---|---|---|
| 467070 | 6/1914 | France | 40/17 |
| 937188 | 9/1963 | United Kingdom | 40/17 |

*Primary Examiner*—John F. Pitrelli
*Assistant Examiner*—G. Lee Skillington
*Attorney, Agent, or Firm*—Salter & Michaelson

[57] ABSTRACT

A device such as an earring card having a main panel adapted to display jewelry articles while oriented in a generally vertical position by suspension from a rod or the like. Preferably, the upper portion of the main panel adjacent to a centrally disposed display area includes a pair of vertically spaced, parallel, outwardly extending flanges, which in combination with that portion of the main panel disposed therebetween form a slot or groove adapted to receive a secondary panel on which advertising or other identifying material may be placed. Accordingly, the secondary panel is removable such that the indicia may be changed without modifying the package. Means for preventing the lateral movement of the second panel with respect to the first is provided either in the form of an upwardly extending tab adapted for receipt in an opening in one of the flanges or by means of a plurality of serrations provided on opposite edges of the second panel for frictional engagement with the flanges.

3 Claims, 9 Drawing Figures

REMOVABLE IDENTIFICATION PANEL FOR EARRING CARDS

BACKGROUND AND SUMMARY OF THE INVENTION

This invention relates to a display device and particularly to a device adapted to display jewelry articles such as earrings and the like. A common way of supporting such items for display is to attach them to the front face of a generally planar panel which in turn is provided with a rearwardly extending flange or clip portion such that the panel may be supported from a display rod or the like in a generally vertical position. The post portions of the earrings are adapted to extend through openings provided in the panel and are retained thereon by the conventional clasp mechanisms provided therewith. In such constructions, it is also common to provide the area of the panel to which the jewelry articles are attached with decoration of some type including attachment thereto of a decorative element, such as a felt pad, or by providing a flocked coating in such area.

It is furthermore common to provide means of identifying either the particular jewelry items displayed by the name or trademark thereof as well as in some cases identifying the manufacturer, distributor or the like on the face of the panel. Generally, identification or advertising indicia of this type is directly imprinted into the surface of the panel and accordingly limits the use of the display device. This necessitates the maintenance of separate inventories for different distributors, customers and the like. Such can be expensive and accordingly it is an object of the present invention to reduce the expenses associated with the maintenance of such separate inventories.

Additionally, inasmuch as the major portion of earrings and other jewelry mounted on such cards at point of purchase displays is of the type subject to rather abrupt changes in demand both with respect to geographical and customer preferences, such may also lead to the necessity of remounting the earrings on cards provided with the then appropriate advertising or identification indicia. Normally, this requires that the earrings be removed from a card bearing the outdated indicia, and then the earrings remounted upon a similar card bearing the new indicia. Obviously, such involves considerable expense and it is accordingly an additional object of the present invention to reduce the costs normally associated with the provision of different, i.e. more up-to-date indicia on cards of this type.

These and other objects of the present invention are accomplished by a device for the display of jewelry articles and the like comprising, a first panel having means for suspending the device in a generally vertical plane, said first panel having a generally planar face including a display area having means adapted to receive at least a portion of an article displayed thereon, said first panel further including a pair of integral vertically spaced parallel flanges extending forwardly from said panel face at a location other than in said display area so as to define a laterally extending channel or slot. Each flange terminates in an enlarged portion or bead so as to provide the laterally extending slot or channel with a reduced entrance portion whereby said slot or channel is adapted to receive a generally flat laterally oriented second panel therein with said second panel in face to face contact with said first panel portion so as to identify and/or advertise the jewelry displayed on said device. Said second panel is of a vertical height generally corresponding to that said slot or channel and said second panel includes means cooperating with said at least one of said flanges for maintaining said second panel against lateral movement within said slot.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
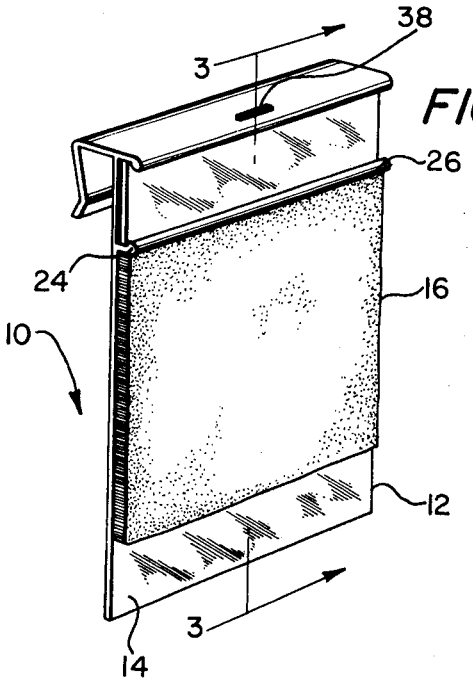
FIG. 1 is a perspective view showing one form of the display device of the present invention.

Referring to the drawing and in particular FIGS. 1–7 thereof, one form of a display device 10 of the present invention is shown. Such device includes a first or main panel 12 of generally planar configuration and having a front face 14 on which a decorative flocked pad 16 is attached as by adhesive connection. That portion of the first panel 12 underlying the pad 16 is conventionally provided with a pair of cut out ear portions each having an opening therethrough (not shown) for receipt of the shaft portion of a post type earring (also not shown). As is known, the posts of the earring pair are inserted through the openings and clamped on the opposite side of the panel by their conventional clasp retention members and in this manner the earring pair is mounted for point of sale display upon the device 10. Normally a plurality of such devices 10 are displayed as by their suspension on rods and the like provided in a display case or racks (not shown).

Figure 2:
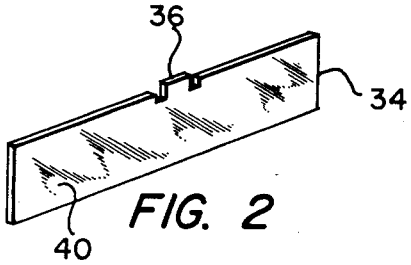
FIG. 2 is a perspective view of an identification panel associated with the device shown in FIG. 1.
Figure 3:
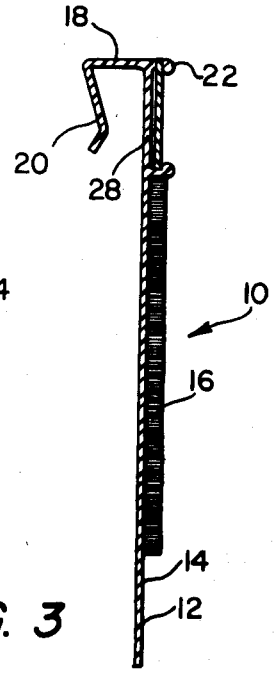
FIG. 3 is a side sectional view taken along the line 3—3 of FIG. 1.

Such suspension means includes a flange 18 which rearwardly extends from the top edge of the first panel 12 and terminates in a downwardly extending portion 20 so as to form a generally U-shaped configuration such that the device 10 may be supported upon a display rod in a generally vertical position. The upper flange 18 also extends forwardly of the front face 14 of the first panel 12 and terminates in an enlarged laterally extending rounded bead 22. Another flange 24 extends from the first panel 12 forwardly thereof and terminates in a similar laterally extending rounded bead 26. Such second flange 24 is parallel to and vertically spaced beneath the forward portion of the upper first flange 18 and in combination with that portion 28 of the first panel 12 disposed between such flanges forms a generally C-shaped, laterally extending, open ended channel or slot 30. Such slot 30 includes an open face having an entrance portion 32, which because of the enlarged dimensions of the beads 22 and 26 is of a reduced height than that of the slot 30. The slot 30 is thus undercut and adapted for receipt of a second panel 34 also of generally planar configuration and laterally extending, i.e. of strip form, as best shown in FIG. 2. The height of the second panel 34 roughly conforms to that of the channel 30 and accordingly is greater than the entrance portion 32 thereof. The upper edge of the second panel 34 is provided with an upwardly extending tab 36 which in turn is adapted for receipt in an opening 38 provided generally centrally of the upper flange 18.

Figure 4:
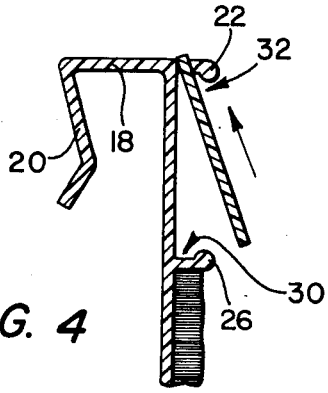
FIG. 4 is a sectional view on an enlarged scale of a portion of the display device shown in FIG. 3 showing the manner in which the display panel is initially positioned prior to the assembly or disassembly thereof.
Figure 5:
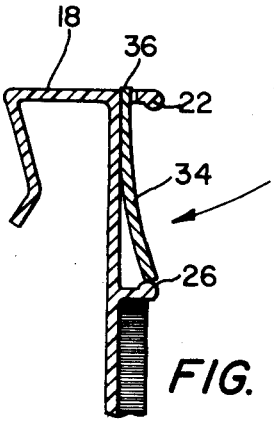
FIG. 5 is a view similar to FIG. 4 and more particularly shows the manner in which the identification panel may be snap engaged into relationship with the main panel.
Figure 7:
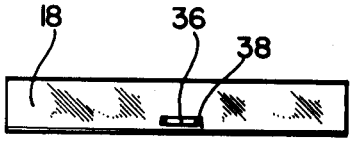
FIG. 7 is a top plan view of the display device shown in FIG. 1.
Figure 6:
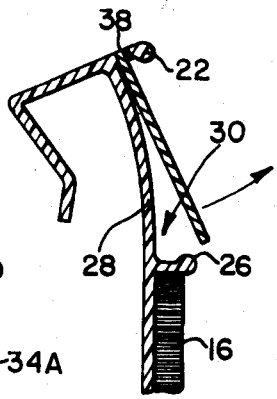
FIG. 6 is a view similar to FIGS. 4 and 5 but showing the manner in which the main panel may be flexed so as to assist in the removal (and insertion) of the identification panel with respect thereto.

The manner in which the second panel 34 is adapted to be positioned in the slot 30 is best shown in the transition between FIGS. 4 and 5 of the drawing. Therein, the initial procedure is to orient the tab 36 with the opening 38 and upwardly force the second panel 34 into the slot 30 such that the tab is received within the opening 38. Thereafter, the second panel 34 is pivotally swung to a face to face disposition with that portion 28 of the first panel disposed between the flanges 18 and 24. In this regard, it should be brought out that the second panel as well as the first panel are formed of a generally flexible plastic material. Thus, the second panel will bend upon engaging the bead 26 and thereafter ride over the top portion thereof, i.e. for snap engagement into the slot 30 whereupon it is held in a laterally secure position, that is, the panel 34 will not move laterally relative to the panel 12 because of the interengagement of the tab 36 within the opening 38.

When it is desired to remove the second panel 34 from the slot 30, the first panel 12 or at least the portion 28 thereof is rearwardly flexed so as to increase the distance between the flanges 24 and 18 and thus simultaneously increase the height of the entrance portion 32 thereof. Thereafter, the lower end of the second panel 34 may pass over or be forced over the bead 26 to a position where it may be easily grasped by ones fingers and then by a downward movement may be removed from the slot 30 altogether. Also, the first panel may be similarly flexed to increase the height of entrance portion 32 to facilitate the entry and/or removal of the second panel 34 with the slot 30.

In accordance with the present invention, the front face 40 of the second panel 34 is provided with indicia, i.e. advertising and/or identification of the jewelry articles displayed upon the device 10. Accordingly, if there is a need for such indicia to be modified for any reason, it is relatively easy to remove the identifying second panel 34 and replace it with a similar panel provided with the more current indicia. Such obviates the need for the more extensive and accordingly expensive procedure not only from the point of labor involved but also of inventory maintenance, i.e., providing a completely new display device and removing the jewelry articles from one such device to another bearing the currently correct indicia.

Figure 8:
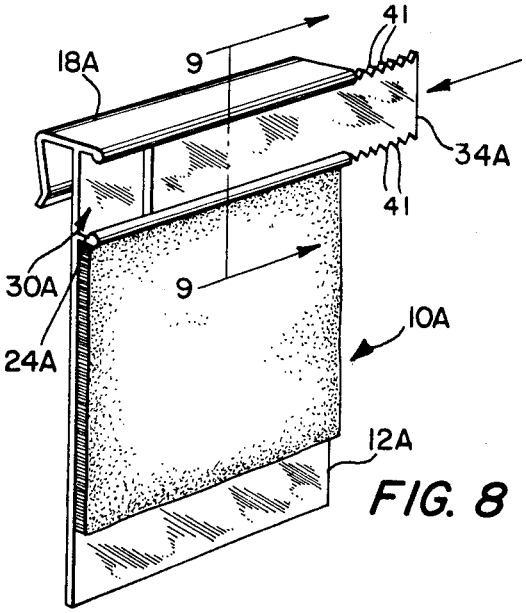
FIG. 8 is a view similar to FIG. 1 but showing a different embodiment of the present invention.
Figure 9:
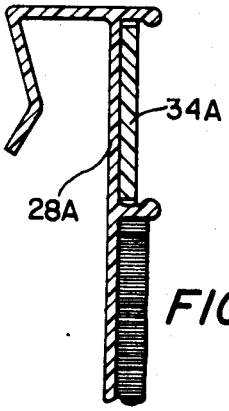
FIG. 9 is a side sectional view thereof taken along the line 9—9 of FIG. 8.

Turning now to FIGS. 8 and 9 of the drawing, a modified form of the device 10A is depicted therein. A first panel 12A similar in all respects to that of panel 12 is provided with the exception that no opening 38 is necessarily provided in the upper flange 18A thereof. A similar slot 30A is however provided by the interaction of the main or first panel 12A and a pair of flanges 18A and 24A. A second panel 34A of modified form and having its upper and lower edges respectively provided with a plurality of serrations 41 is included. This second panel 34A is adapted for receipt in the slot 30A. The peak to peak height of the second panel 34A, that is, the distance between opposed peaks of serrations 41 on opposite edges of the second panel 34A is equal to or slightly greater than the height of the slot 30A such that an interference or frictional fit is preferably brought out between the second panel 34A and the inner surfaces of the flanges 18A and 24A. Thus, in order to dispose the second panel 34A in position with respect to the first panel 12A, it is necessary to either initially slip one end of the second panel 34A into one of the open edges of the slot 30A and thereafter forceably push the second panel 34A along the slot 30A as by ones fingers or alternatively, as in the previous embodiment, the upper portion 28A of the first panel 12A may be rearwardly flexed so as to increase the height of the entrance opening of the slot 30A and thus permit the second panel 34A to be inserted thereinto in a properly centered position. Thereafter, regardless of how the second panel 34A was mounted within the slot 30A, the frictional relationship between its serrated edges and the flanges 18A and 24A will effectively prevent lateral movement of the panel 34A. When it is desired to replace the second panel 34A with a different and similar panel, such may be either forceably laterally removed along the slot 30A or the slot entrance may be increased as by the rearward flexure of the first panel portion 28A as previously discussed. Accordingly, the object of the present invention is similarly achieved by the modified embodiment shown in FIGS. 8 and 9 of the drawing.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A device for the display of jewelry articles and the like comprising, a flexible first panel having means for suspending the device in a generally vertical plane, said first panel having a generally planar face including a display area having means adapted to receive at least a portion of a jewelry article displayed thereon, said first panel further including a pair of integral spaced flanges extending forwardly from said panel face, said spaced flanges being configured so as to define an elongated channel therebetween having a reduced entrance portion, said channel being adjacent to but displaced from said display area and having removably mounted therein a generally flat elongated second panel with said second panel disposed in face to face contact with said first panel portion and adapted to receive indicia thereon so as to identify and/or advertise the jewelry displayed from said device, said second panel being dimensioned so as to fit snugly within said channel, the latter dimension of said second panel being greater than said reduced entry portion of said channel, and means resisting longitudinal movement of said second panel relative to said channel.

2. The device of claim 1, said resisting means comprising an opening in one of said flanges, and a tab extending from one of the edges of said second panel, said tab extending into said opening.

3. The device of claim 1, said resisting means comprising serrations on the upper and lower edges of said second panel in frictional engagement with the inner surfaces of said flanges.

* * * * *